US005111879A

United States Patent [19]

Jozwiak et al.

[11] Patent Number: 5,111,879

[45] Date of Patent: May 12, 1992

[54] SANITARY LOCKING LIP SPLIT WELL SEAL

[75] Inventors: Terry H. Jozwiak, Witter; Eugene C. Hunley, Jr., Rogers, both of Ark.

[73] Assignee: Amtrol Inc., West Warwick, R.I.

[21] Appl. No.: 533,838

[22] Filed: Jun. 6, 1990

[51] Int. Cl.[5] ..... E21B 33/02

[52] U.S. Cl. ..... 166/82; 166/84; 166/93; 277/220

[58] Field of Search ..... 166/75.1, 82, 84, 92–94, 166/97.5; 277/221, 222, 220

[56] References Cited

U.S. PATENT DOCUMENTS

| | | | |
|---|---|---|---|
| 210,848 | 12/1878 | Gingras | 277/220 |
| 239,111 | 3/1881 | O'Meara | 411/539 |
| 331,458 | 12/1885 | Stetzer | 277/20 |
| 647,928 | 4/1900 | Adams | 411/539 |
| 885,899 | 4/1908 | Willard | 277/220 |
| 948,600 | 2/1910 | Vannoy . | |
| 990,017 | 4/1911 | Shull | 277/220 |
| 1,151,131 | 8/1915 | Starliper | 411/539 |
| 1,191,565 | 7/1916 | Chambers . | |
| 1,525,582 | 2/1925 | Hosmer | 166/93 |
| 1,708,645 | 4/1929 | Wright | 166/93 |
| 2,220,359 | 11/1940 | Tschappat | 166/75.1 |
| 2,759,777 | 8/1956 | Anderson | 308/187 |
| 2,931,379 | 4/1960 | Haydin | 166/75.1 |
| 2,957,524 | 10/1960 | Earl | 166/97.5 |
| 3,393,740 | 7/1968 | Seese et al. | 166/84 |
| 3,495,496 | 2/1970 | Keim | 85/51 |
| 3,776,559 | 12/1973 | Cawthorn | 277/56 |
| 3,784,215 | 1/1974 | Ruthenberg | 277/218 |
| 4,262,168 | 4/1981 | Bossard | 174/77 |
| 4,274,323 | 6/1981 | Resnicow | 411/433 |
| 4,533,149 | 8/1985 | Vater et al. | 277/221 |
| 4,540,186 | 9/1985 | Beidler | 277/195 |
| 4,565,380 | 1/1986 | Newman et al. | 277/178 |
| 4,655,463 | 4/1987 | Inciong et al. | 277/180 |
| 4,674,756 | 6/1987 | Fallon et al. | 277/30 |
| 4,844,484 | 7/1989 | Antonini et al. | 277/153 |
| 4,844,487 | 7/1989 | Eakin | 277/221 |

*Primary Examiner*—Bruce M. Kisliuk
*Attorney, Agent, or Firm*—Fisher, Christen & Sabol

[57] ABSTRACT

A well seal and split packer for a well seal. The well seal includes a split packer having interconnecting lips to allow the packer to be slipped around one or more installed drop pipes while providing an essentially leak-proof seal after installation without the use of adhesives or adhesive-type flexible sealants.

4 Claims, 5 Drawing Sheets

SANITARY LOCKING LIP SPLIT WELL SEAL

BACKGROUND OF THE INVENTION

1. Field of the Invention

The invention relates to well seals. The invention also involves well seals having a split packer.

2. Background Art

Well seals are known which are intended for use With submersible water systems to prevent contamination due to surface drainage. The well is sealed by the expansion of a rubber packer, sandwiched between two metal castings. When the bolts are tightened, the castings are drawn together, thereby expanding the diameter of the packer and forming a seal. Besides use with single drop pipe arrangements, well seals are used with two-pipe jet pump arrangements.

U.S. Pat. No. 948,600 (Vannoy) describes a washer which has movable hinged sections with an aperture in the middle. The hinged sections are connected together at one end by a transverse pivot pin. Formed on the contact faces of one of the sections are tongues which are of a size so as to securely engage grooves formed in the opposed contact faces of the companion section. A spring lock which can hold the sections locked together is present on the circumference of one of the contact faces. The spring lock comprises a spring catch carried by one of the sections and a seat for engagement with the catch carried by the other section. To install the washer, the sections are opened to their widest extent and one half of the section is inserted around the tube, or contact surface. The other half is rotated around the tube, coupling, etc., and clamped so that the sections are engaged and form a tight seal. To remove the washer, the inner wall of the recess or seat is inclined upwardly and rearwardly to form an opening into which an instrument can be inserted to pry open the head of the spring catch. The Vannoy washer can only be removed by inserting a sharp instrument and prying the spring head, which may rupture the seal. Further, the Vannoy washer does not appear to be easily twistable, thereby making installation of the Vannoy washer difficult and complex.

U.S. Pat. No. 210,848 (Gingras) describes a leather washer having halves with an opening in the middle. On the circumference of the washer are provided dovetailed tenons and grooves which interlock. The leather washers are made and then enrobed in liquid cement and subjected to compression at the joints to firmly adhere in a die from it dipping into cement and allowing it to set. The method of making the washer suggests that once made, it would not be possible to twist the washer.

U.S. Pat. No. 2,759,777 (Anderson) describes a sealed bearing structure. The elastic sealing ring can be a continuous or split ring and also can be made from materials like rubber. The sealing ring has a central bore and circumferentially placed notches and abutments, or hook-like elements, which interlock to provide a tight seal. The seal is placed in an annular groove. The annular groove forms a part of the section of an annular sealing plate. The section extends axially inwardly and has a cylindrical outer surface which is concentric with and spaced from the adjacent surface of the bore. The seal ring works by exerting an expanding action on the cylindrical surface of the plate section and forms a sealing contact therewith. The Anderson washer is specifically designed for installation with an anti-friction bearing.

U.S. Pat. No. 4,533,149 (Vater et al.) describes a split seal ring with an interlocking cut. This seal ring is preferably made up of PTFE, but can also be made of elastomeric materials. The seal ring fastening system has a detachable locking arrangement in both the radial and longitudinal directions. The arrangement has an interfitting wedge lock preventing radial displacement of the seal ends and a tongue and groove lock which prevents longitudinal uncoupling thereof. The seal ring is preferably placed in an annular groove machined into a rotatable shaft. The actual installation is easy and consists of opening the lock and placing the ring in the groove and locked in place by a single snap-on movement.

U.S. Pat. No. 4,844,487 (Eakin) describes a split sealing ring having a latch structure of overlapping, interengaging surfaces inclined to the axis of the ring, whose inclined surfaces seat against each other and intersect only the outer circumferential face of the ring and one of the axial faces of the ring at a location spaced radially outwardly from the inner radial face of the ring and the axial opening through the ring at the center of the overlap is entirely surrounded by portions of the outer circumferential face of the ring.

U.S. Pat. No. 4,262,168 (Bossard) describes a split sealing washer. The composite washer is comprised of two identical flexible mating half-washers each offset along a diameter and slit along an offset radius. The two half-washers are mated after being slipped over a cable section to provide a fluid resistant barrier in a cable splice enclosure. The washer, however, has all the disadvantages of a washer that is conventionally split and then installed, i.e., the fluid has a straight path at the splits to seep or leak.

U.S. Pat. No. 3,776,559 (Cawthorn) describes shaft seals which comprise a split annular body made of resilient material to surround and engage the shaft and a split ring adapted to surround the body and having its ends shaped to engage each other in a locked condition.

U.S. Pat. No. 1,151,131 describes a shaft collar which has two complementary sections, each section being formed at its ends with a radially extending dovetail projection and a radially extending dovetail recess inward of the projection. The recess and projection on one section interlock and mate with the projection and recess on the other section.

U.S. Pat. No. 1,191,565 describes an adjustable washer. The washer has an annular body having relatively movable free ends and a securing means. The securing means has a recess at an end and a dovetail means at the opposite end slidably mounted within the recess.

U.S. Pat. No. 3,495,496 describes a ring member which is adapted to be placed around a shank. The ring member has a non-continuous, ring-shaped planar body with first and second end portions joined by a center portion. The first end portion has two wall sections defining therebetween a recess which extends parallel to the plane of the ring across the end of the end portion. The second end portion has a projection which fits into the recess of the first end portion when the ring is in the closed position.

U.S. Pat. No. 4,274,323 describes a shaft mounted assembly. The assembly includes a first member which comprises at least two segments and a retainer or locking member which interlocks with the segments when the segments are placed around the shaft to retain the segments on the shaft.

U.S. Pat. No. 331,458 describes a spring piston-packing ring. The ring is made from one piece of material, and has a notched lap (K in FIG. 1) and a circular periphery corresponding to the circular periphery of the inner surface of the cylinder in which it is used. The assembly allows the ring to form itself into an inherent adjusting spring.

U.S. Pat. No. 647,928 describes a washer composed of two semicircular parts. Each of the parts has its ends divided into two leaves. All of the leaves are provided with a catch at the end thereof, and a depression in rear of such catch. The catches on each of the parts have beveled engaging edges, and are adapted to engage the depressions in the leaves of the other part. Each alternate leaf on either of the parts has lateral resistance in an opposite direction to the one preceding. The parts are adapted to be securely and firmly locked together.

U.S. Pat. No. 3,784,215 describes an interlocking joint assembly for annular split sealing rings where overlapping end sections form both radial and axial sealing faces. The end sections are formed with axially opposed overlapping segments creating a pair of axially overlapping radial sealing interfaces at the opposed ends of the sealing ring and a pair of axially offset axial sealing interfaces extending radially from the midportion of the ring to the outer radial face of the ring.

BROAD DESCRIPTION OF THE INVENTION

An object of the invention is to provide an improved well seal having a split packer. Another object of the invention is to provide an improved well seal having a split packer with a leakproof jointing structure. Other objects and advantages of the invention are set out herein or are obvious herefrom to one skilled in the art.

The objects and advantages of the invention are achieved by the well seal having a split packer of the invention.

The invention involves improved well seals having a split packer. The split packer is defined by two sections having interconnecting lips, which allow the sections to be locked together after installation. The interlocking lips provide an effective sanitary liquid leakproof seal by defining a substantially leakproof labyrinth path between the interlocking lips as compared with a conventional straight-through path. In other words, there is an interlocking joint assembly having cooperating pairs of radial sealing interfaces and pairs of axial sealing interfaces. The two sections are connected together at one end to form an integral unit having a flex point, or flex portion, which allows the sections to be split apart during installation and subsequently interlocked together by the interconnecting lips. Further, the split packer is provided with at least one through hole, preferably a tapered through hole which tapers inwardly from an interior portion of the split packer to an exterior portion thereof. The split packer can be reused if it is necessary to remove the well seal to work on the pipe or pipes or pump in the well casing. The split packer can be opened and closed many times without damage to the flexible split packer.

The well seal includes a pair of split plates that can be clamped together for expanding the split packer between the plates. For example, a set of bolts extending through the outer plate and threaded into the inner plate allows clamping of the split packer between the plates.

The interlocking lips of the sections of the split packer preferably are formed by square notches near the inner edges (ends) of the two sections with the thickness of the inner edges reduced to form abutments or book-like elements (the notches and hook-like elements overlap and interlock). In the preferred form, the hook-like elements will have a shape which mates with the square notches to provide the best leakproof results. The notches can have other shapes, such as, U-shaped, and the shapes of the hook-like elements advantageously have mating shapes.

The two section of the split packer form a unitary body, that is, they are not two separate parts. The split packer of the invention preferably uses two hinged separate parts. While the invention split packer is a unitary body, the two sections thereof are substantially semi-circular, flat-faced sections (when the well to be sealed has a circular horizontal cross-section).

The split packer of the invention is preferably comprised of a resilient, flexible rubber which is relatively hard so as to provide a tight, leakproof seal when the interlocking lips are interconnected (and under compression by the two plates). The split packer of the invention can also be composed of any other resilient, flexible material which meets such requirements.

The invention also involves an improved packer for a conventional well seal, defined as a split packer. The well seal has a pair of clamping plates. The split packer has a first section and a second section. The first section and the second section have interlocking lips to provide an effective sanitary seal by providing a leakproof labyrinth path to avoid a straight-through leak path. The first section and the second section when interconnected together form a packing unit provided with at least one through hole and being of size and shape about the same as the inner dimensions of a casing of a well. The split packer can be locked in place by a single snap-together movement, thereby holding itself together during the installation movement into the well casing pipe.

The first section and the second section preferably are connected together at one end to provide an integral unit having a flex point and having a split line formed by the interface between the non-connected portions thereof. The split packer is preferably provided with at least one tapered through hole. Preferably the through hole is located partially through each section along the split line. The split packer is best composed of resilient rubber, but can be any suitable resilient or elastic material such as, a resilient, elastomeric plastic, which has good long-term stability to the outdoors atmosphere.

Sanitary well seals are used to prevent surface water from rain, septic systems, etc., from contaminating a water well. Well seals are also used to prevent well fluids or gases, as in the oil and gas industry, from escaping and contaminating the above ground environment. Most well seals use a rubber or synthetic rubber seal, called a packer, clamped between two metallic (or rigid material) plates. These plates and the rubber seal have holes through them which allow bolts to pass through. These bolts are tightened, squeezing the rigid plates together, which in turn squeezes the rubber seal, causing it to deflect outwardly against the well casing and inwardly against and around the drop pipe or pipes and the through bolts to effect a seal. To install the rubber packer portion of the seal, the rubber must be slipped over the end of the drop pipe (or pipes) before fittings, elbows, or other finishing connections are made, and then the drop pipes must be pushed up or down through the seal for final installation before the seal is fully installed and energized. Manufacturers offer split well seals to attempt to alleviate this problem for installers, but because of Health Department requirements, the rubber seal itself cannot be split or it will not seal and therefore will not be a sanitary seal. Split well seals are therefore only split in the rigid plates. Typically, an installer will use a knife and split the rubber packer for convenience, resulting in a non-sanitary seal. It is non-sanitary because this joint where the packer has been split is now a leak path through which contaminants can pass.

The invention design allows the packer to be molded in a split condition, but with interlocking lips that provide a preenergized labyrinth path through which contaminants would have to pass to escape. When energized by tightening of the bolts, these interlocking lips maintain the joint relationship and behave as though the seal was a solid piece. Behaving as a solid piece allows it to seal completely and, thus, provides a sanitary seal to satisfy Health Department requirements.

During installation of the invention device, the installer does not have to remove any of the fasteners or cut the packer. The installer can twist the assembly halves apart far enough to allow it to pas around the drop pipe(s) and then push the open ends together to engage the locking lips between the metallic clamping plates. The locking lips then hold the seal together due to the spring force at the continuous molded side, while the seal is being positioned down the drop pipe(s) into the well casing. Once installed into the casing, the bolts are tightened to compress the packer and energize the packer against itself as well as the casing wall and drop pipe(s), resulting in a sanitary seal.

In addition, the holes through which the drop pipes pass are tapered to provide a thinner lip on one side than the other side. This thinner lip deflects at a much lower compressive force and still provides a sanitary seal when bolt torque is not consistent. This taper, large diameter bottom-small diameter on top, also allows the well seal assembly to slide down the drop pipes more easily during installation into the well casing.

The invention well seal, including the invention split packer, provides the following advantages, among others:

1. The interlocking lips provide an effective sanitary seal and the labyrinth path eliminates a straight-through leak path.

2. It works with pressure on either side.

3. The split design allows assembly onto and around drop pipes after installation of elbows or couplings without requiring cutting of the sealing packer.

4. The interlocking lips hold the well seal assembly together by pulling against its own shoulders of the lips due to the resilience of the packer material trying to spring open to its as-molded condition.

5. The interlocking lip allows visual verification of correct alignment of the packer prior to installation into the well casing, assuring a sanitary seal on the first try.

6. The interlocking lips effect a seal at a lower clamping pressure, thereby reducing the stress on the bolts, clamp plates, and packer materials, which in turn extends the effective life of the product.

7. The use of the interlocking lips negates the need to use multiple packers which have been cut. Typically, in the prior art, four packers are used—one on top of the next, with the split lines oriented at 90° progressively to the packer above and below it, to prevent straight line alignment of the leak path. This also requires longer fasteners to be used, which themselves stretch under load resulting in loss of sealing force, or lesser sealing force.

8. The drop pipe holes are tapered, which allows sealing to occur at lower compression forces due to uneven or inconsistent bolt tightening by the installers.

DETAILED DESCRIPTION OF THE INVENTION

Figure 1:
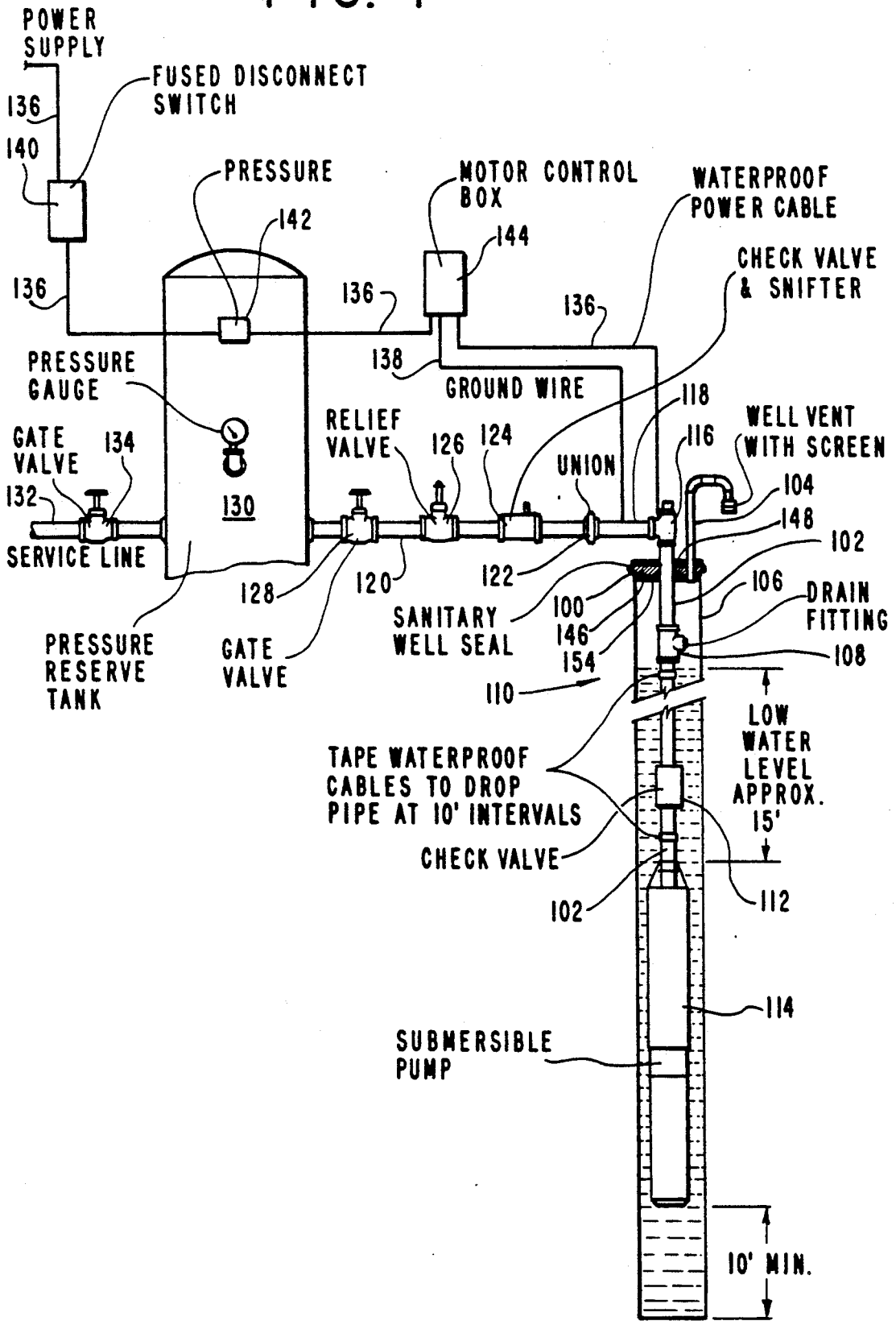
FIG. 1 is a schematic diagram of a sanitary well wherein the well seal, which includes a split packer according to the invention as installed, for a single drop pipe submersible pump application.

Referring to FIG. 1, water well 110 has well casing 106 with well seal 100 according to the invention shown installed in the top of well casing 106 in a sanitary, sealing manner. Drop pipe 102 extends through well seal 100. Drop pipe 102 has a number of sections, depending upon the depth of water well 110. Submersible pump 114, positioned near the bottom of water well 110, is affixed to the bottom of drop line 102. Drain fitting 108 is positioned in drop line 102 at a position normally above the water level in water well 110. Check valve 112 is positioned in drop line 102 above submersible pump 114. L-shaped pipe connection 116 is connected to the top of drop line 102 (above water seal 100). Pipe segment 118 is connected to T-shaped connection 116 and to pipe line 120 via union 122. Check valve (and snifter) 124, relief valve 126 and gate valve 128 are positioned in pipe line 120. The other end of pipe line 120 is connected to pressure reserve tank 130. Service line 132 is connected to pressure reserve tank 130. Gate valve 134 is positioned in service line 132. Power line 136 is electrically connected to the power supply (not shown). Fused disconnect switch 140, pressure unit 142, motor control box 144 and submersible pump 114 are electrically connected to or in water-proof power line 136. Ground wire 138 connects motor control box 144 to pipe segment 118. Well vent (with screen) 104 is positioned in well seal 100.

Well seal 100 provides a cover for the top of well 110 and seals with the inner surface of casing 106, the peripheral surface of drop pipe 102 and the peripheral surface of water-proof power cable 136.

Figure 4:
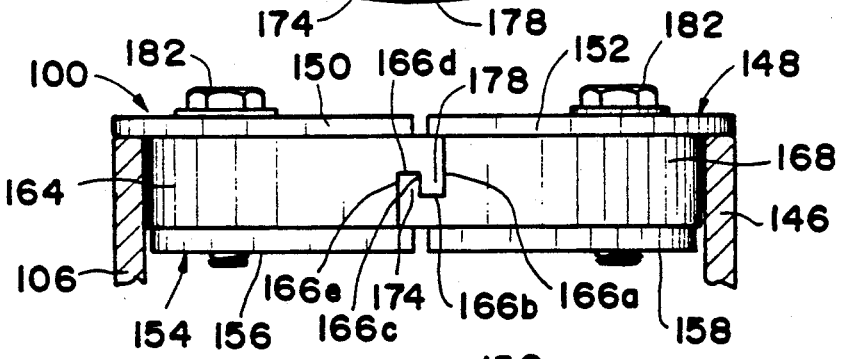
FIG. 4 is a side view of the assembled well seal, including the split packer of FIG. 2, installed in a well casing pipe.
Figure 9:
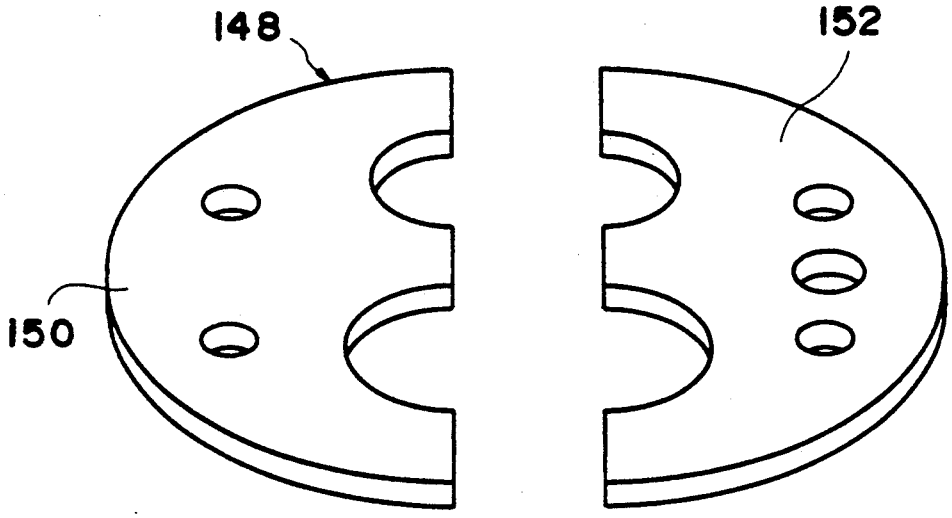
FIG. 9 is a top perspective view of the outer split plate of the well seal.
Figure 10:
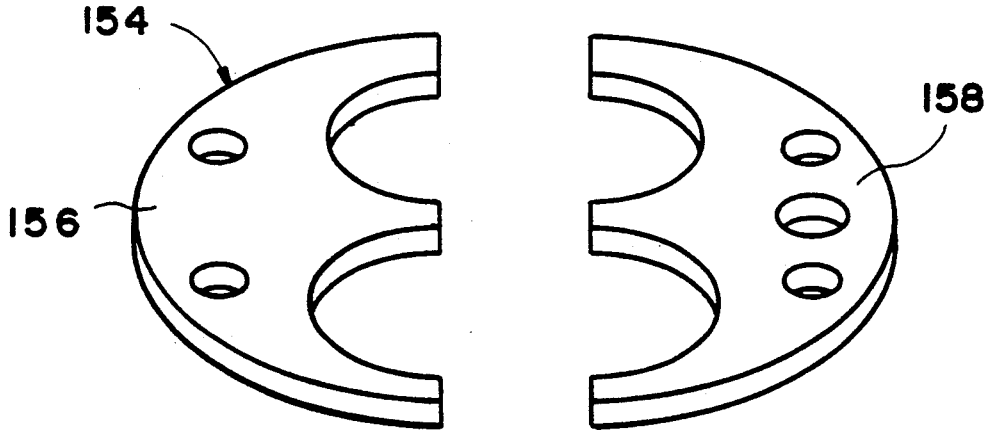
FIG. 10 is a top perspective view of the inner split plate of the well seal.

Well seal 10 includes split packer 146 sandwiched between outer (top) split plate 148 (which has hemispherical sectional parts 150 and 152) and inner (bottom) split plate 154 (which has hemispherical sectional parts 156 and 158), see FIG. 4. Outer split plate 148 and inner split plate 154 are shown in FIGS. 9 and 10, respectively.

Figure 6:
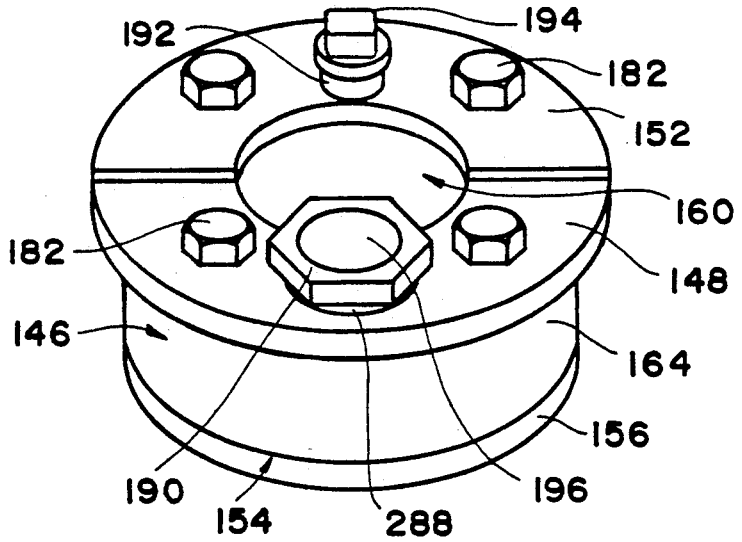
FIG. 6 is a perspective view of another embodiment of the well seal according to the invention for a single drop pipe submersible pump application.

FIG. 1 shows an arrangement for a single drop pipe submersible pump application and would normally use an invention well seal as shown in FIG. 6. The actual well seal shown in FIG. 1 has a second hole for well vent 104.

Figure 2:
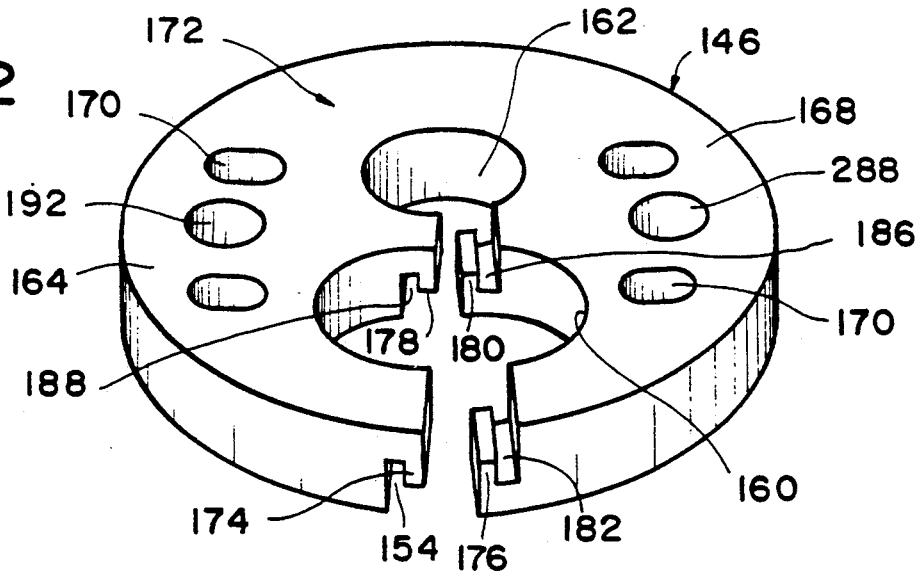
FIG. 2 is a perspective view of the preferred embodiment of the split packer according to the invention, in an open as-molded configuration for double drop pipe jet pump application.
Figure 11:
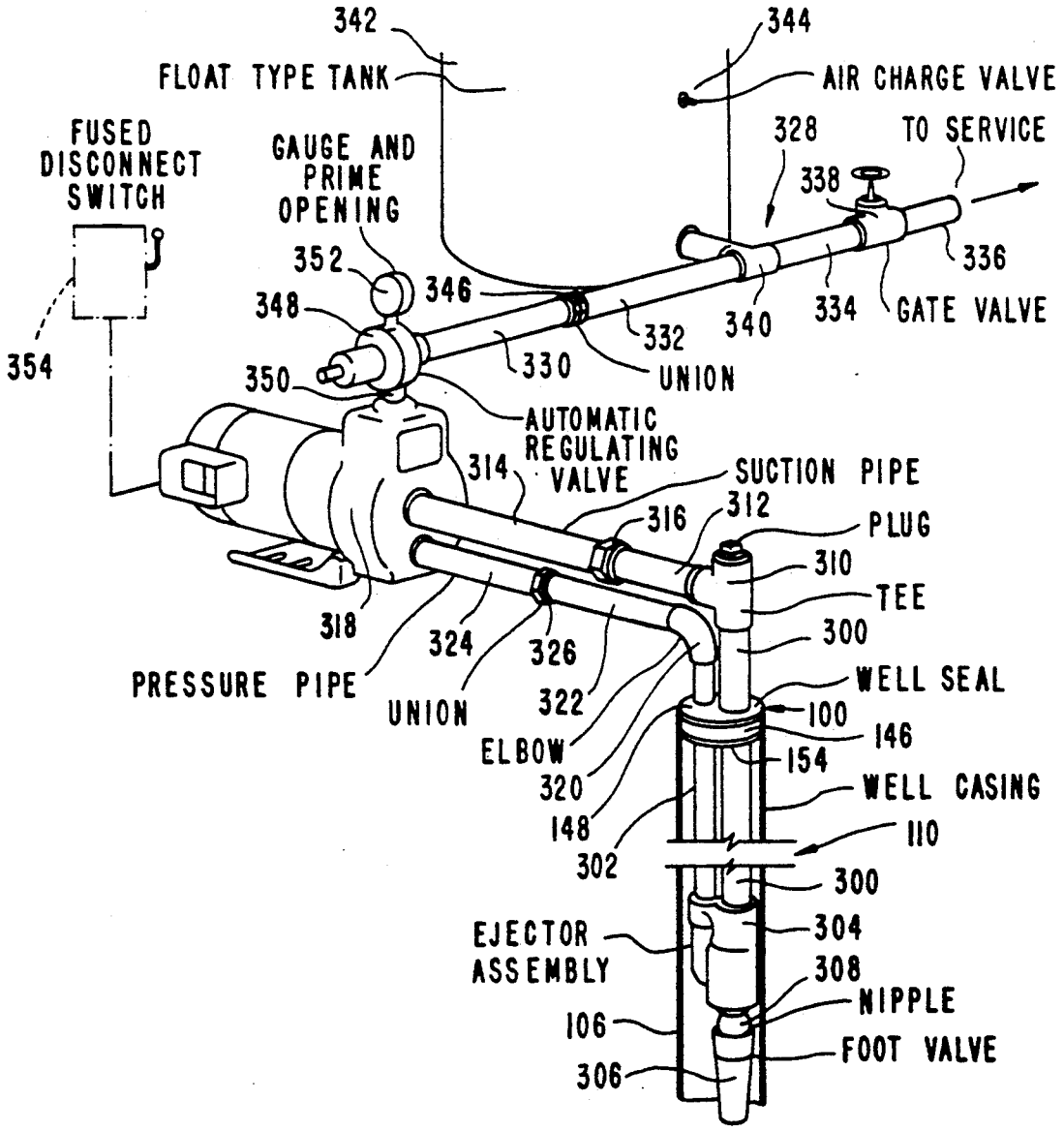
FIG. 11 a schematic diagram of a sanitary well wherein the well seal, which includes a split packer according to the invention, as installed, for a double drop pipe jet pump application.

FIG. 11 shows an arrangement for a double drop pipe (deep well) jet pump application and uses an invention split packer such as split packer 146 (having large vertical apertures 160 and 162) as in FIG. 2.

Referring to FIG. 11, water well 110 has well casing 106 with well seal 100 according to the invention shown installed in the top of well casing 106 in a sanitary, sealing manner. Drop pipes 300 and 302 extend through well seal 100. Drop pipes 300 and 302 have a number of sections, depending upon the depth of water well 110. Submersible double drop jet pump (ejector assembly) 304, positioned near the bottom of water well 110, is affixed to the bottom of drop lines 300 and 302. Drain fitting 108 is positioned in drop line 102 at a position normally above the water level in water well 110. Foot valve 306 is positioned via nipple 308 above ejector assembly 304. T-shaped (tee) pipe connection 310 is connected to the top of drop line 300 (above water seal 100). Pipe segment 312 is connected to tee 310 and to pipe segment 314 via union 316. Pipe segment 314 is connected to pump 318. The suction pipe portion of the jet pump arrangement is formed by drop pipe 300 and pipe segments 312 and 314. Elbow 320 is connected to the top of drop pipe 302 (above water seal 100). Pipe segment 322 is connected to elbow 320 and to pipe segment 324 via union 326. Pipe segment 324 is connected to pump 318. The pressure pipe portion of the jet pump arrangement is formed by drop pipe 302 and pipe segments 322 and 324. Service line 328 comprises pipe segments 330, 332, 334 and 336. Gate valve 338 is positioned in service line 328 between pipe segments 334 and 336. Tee 340 is connected to pressure reserve tank (float type tank) 342 and is positioned in service line 328 between pipe segments 334 and 332. Air charge valve 344 is located in the side of tank 342. Union 346 is located between pipe segments 330 and 332. Automatic regulating valve 348 is connected to pump 318 via pipe segment 350. Pipe segment 332 connects service line 328 to automatic regulating valve 348. Gauge and prime opening 352 is mounted on the top of valve 348. Fused disconnect switch 354 is electrically connected to pump 318.

Figure 3:
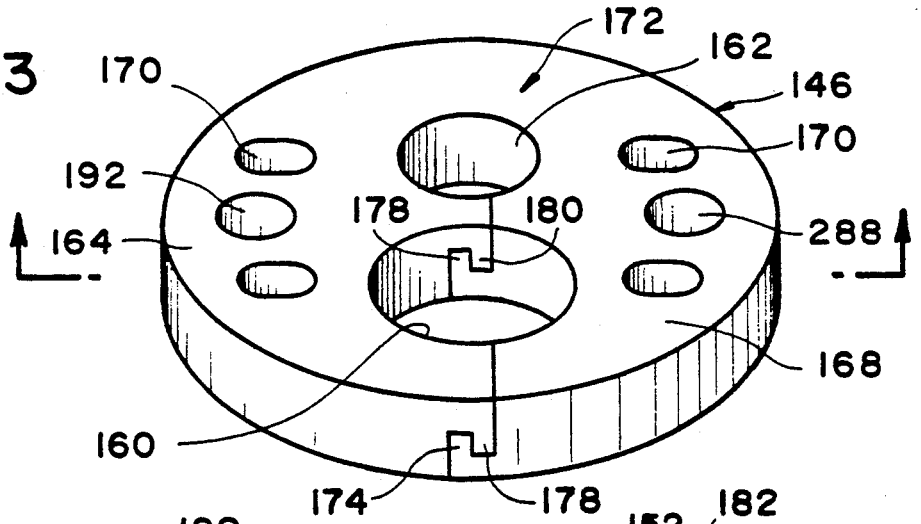
FIG. 3 is a perspective view of the split packer of FIG. 2 in a closed configuration.

Referring to FIG. 2, split packer 146 has large vertical apertures 160 and 162, in which drop lines 300 and 302 fit, and small vertical aperture 192, in which well vent 104 fits (see FIG. 1, for example). Split packer 146 has two hemispherical portions 164 and 168. Each hemispherical portion 164, 168 contains two circular holes 170, whose longitudinal axis is perpendicular to the axis running through the vertical axes of holes 160 and 162. This is best seen in FIG. 3. One or two or more through holes can be provided for drop pipes depending on the pump system utilized. For example, as shown in FIG. 11, two drop pipe through holes can be provided in the well seal according to the invention when installed for application of a two-pipe deep well jet pump. Such a well seal is shown in the embodiment of FIGS. 2 to 5 and 8. Hemispherical portions 164 and 168 are connected (172) at the end beyond small vertical hole 162 to form an integral or one piece unit. Flex point or portion 172 is defined between the interconnection of hemispherical portions 164 and 168 to allow hemispherical portions 164 and 168 to be pulled apart and twisted to accommodate the drop pipes 300 and 302 from the side of split packer 146 during installation. After drop pipes 300 and 302 are positioned in through holes 160 and 162, respectively, hemispherioal portions 164 and 168 can be pushed together and interconnected by interlocking lips 174, 176, 178, 180.

Interlocking lip 174 fits in groove 182; interlocking lip 176 fits in groove 184; interlocking lip 178 fits in groove 186; and interlocking lip 180 fits in groove 188. The leakproof seal defined by interlocking lips 174 and 178 provides numerous sealing surfaces at **166*a*, 166*b*, 166*c*, 166*d* and 166*e*. See FIG. 4. (The same numerous sealing surfaces are also present in the leakproof seal defined by interlocking lips 178 and 180.) The resilient nature of the material forming split packer 146 allows close tolerances between the surfaces and ease of installation. Further, portions of interconnecting lips 174 and 178 can be made slightly oversized or undersized to provide compressive forces between the sealing surfaces in the finally installed arrangement of split packer 146. For example, the distance between surface 166*a* and 166*c* of lip 178 in the non-installed arrangement, can be greater than the distance between the receptacle surfaces of groove 182 prior to installation. Thus, surfaces 166*a*, 166*c* and 166*e* are placed under compression in installed split packer 164** ensuring a good seal therebetween.

Figure 5:
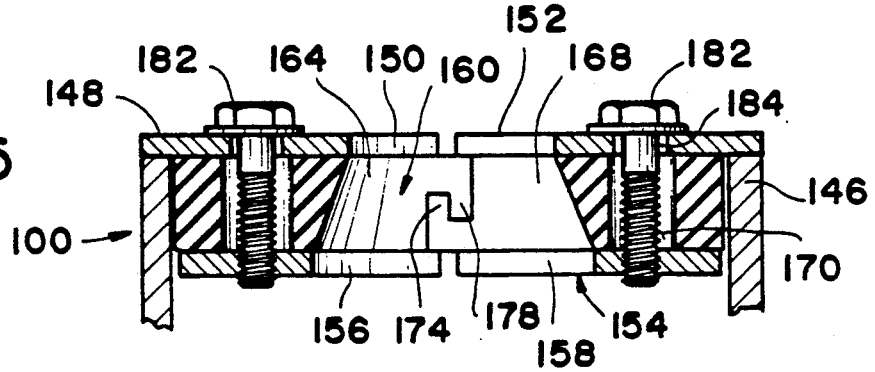
FIG. 5 is a partial cross-sectional view of the assembled well seal including the closed split packer of FIG. 3 along line 5—5 in FIG. 3.

In a preferred embodiment, the one or more through holes through split packer 146 are tapered such as through hole 160, as shown in FIG. 5. This feature provides a tapered fit between split packer 146 and the outer peripheral surface of the drop pipe(s) positioned therein after installation.

Top split plate 148 is made to have larger dimensions (i.e., larger diameter) than inner split plate 154. Further, inner split plate 154 should be made with dimensions approximately slightly less than the inner dimensions of the casing in which it is positioned after installation. This allows clearance for inner split plate 154 to go down into Well casing 106. Also, outer split plate 148 is made with dimensions larger than the inner surface dimensions of casing 106 to prevent well seal 100 from dropping down into casing 106 during installation. The outer edge of outer split plate 148 rests on the top rim of well casing 106. Desirably, the outer peripheral dimensions of split packer 146 are such that split packer 146 is close to, but not in direct contact with, the inner surface of casing 106.

Well seal 100 according to the invention is provided with means for clamping split packer 146 between outer split plate 148 and inner split plate 154—see FIG. 4. Bolts 184 are passed through holes 186 in outer split plate 148 and holes 170 in split packer 146, as shown in FIG. 5. In order to provide the clamping arrangement, bolts 182 are threaded into threaded holes 186 in inner split plate 154 to allow bolts 182 to be tightened, drawing plates 148 and 154 together and expanding split packer 146. Rubber split packer 246, when clamped between outer split plate 148 and inner split plate 154, is compressed and bulges outward against the inner surface of casing 106 to provide a seal between well seal 100 and casing 106.

Figure 7:
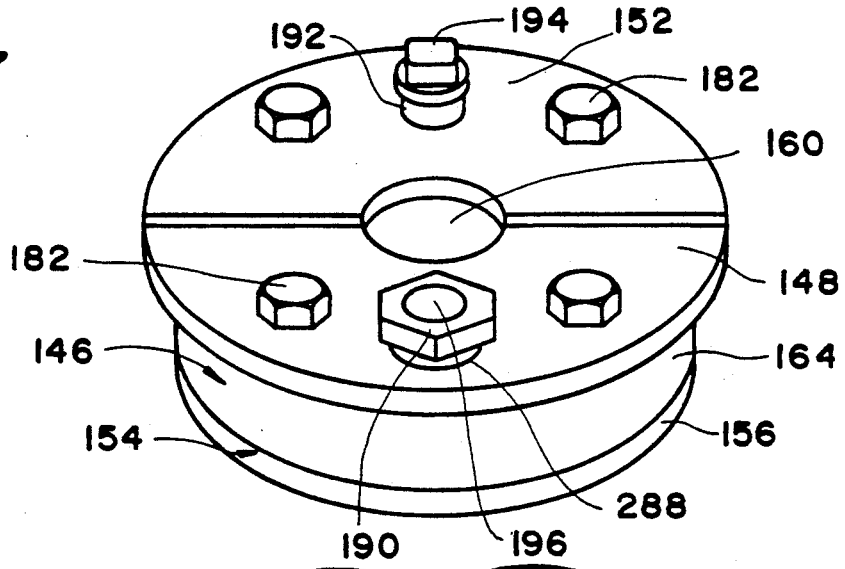
FIG. 7 is a further embodiment of the well seal according to the invention.
Figure 8:
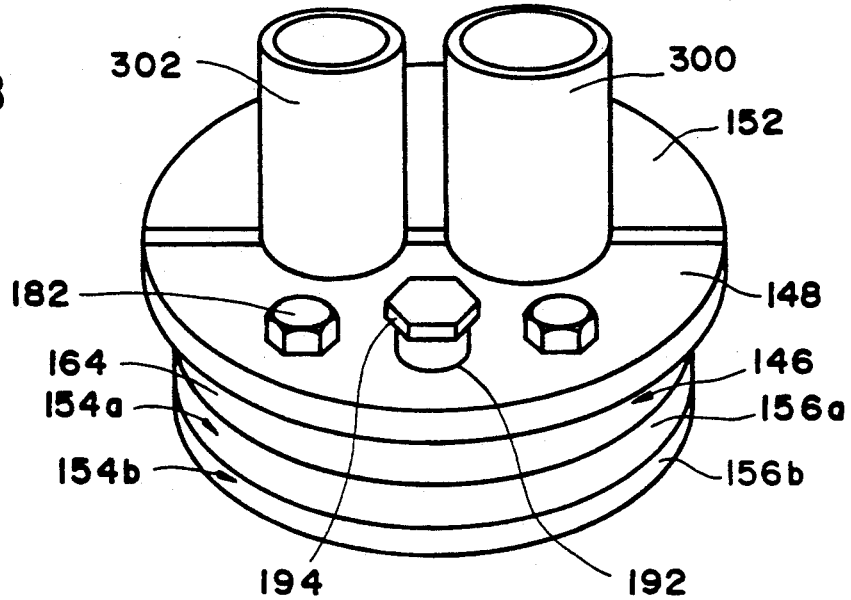
FIG. 8 is an additional embodiment of the well seal according to the invention.

Other embodiments of the well seal 100 according to the invention are shown in FIGS. 6 to 8.

In FIG. 6, well seal 100 is shown having a single drop pipe through hole 160. Threaded vent hole 192 is shown containing temporary vent plug 194 and threaded conduit hole 288 (for a supply line) with conduit nut 190 (having hole 196 in which vent pipe 104 is mounted). (Plug 194 is used only for shipment of well seal 100.) Vent hole 192 and conduit hole 288 extend through outer split plate 148, split packer half 164 and inner split plate 156. FIG. 6 shows a single drop pipe version for a submerisable pump or shallow well jet pump. Likewise for the version shown in FIG. 7.

In FIG. 7, well seal 100 is similar to that in FIG. 7 except that hole 160 is smaller and the periphery of split packer 146 has a sharper taper.

In FIG. 8, well seal 100 has two holes 160 and 162 for two drop pipes 300 and 302. Threaded (tapped) vent hole 192 is shown containing temporary vent plug 194. Well seal 100 has two inner split plates **154*a* and 154*b* (with halves 154*a* and 154*b* being shown). Vent hole 192 extends through outer split plate 148, split packer half 164, and inner split plates 154*a* and 154*b*. FIG. 8** shows a double drop pipe version for deep well jet pump application.

Installation of the well seal according to the invention is described as follows:

After the installation of the single drop pipe, in the case of a submersible pump, or two drop pipes, in the case of a jet pump within the well casing, the well seal according to the invention is then subsequently installed. The split packer is opened by disconnecting the interlocking lips, and twisted and opened to allow installation around the drop pipe(s). Subsequently, the sections of the split packer are pushed together and the interlocking lips are then pressed together to form a leakproof sanitary seal. The assembly is installed as a unit with the outer and inner plates and bolts already assembled to the rubber split packer at the factory. This is a very major convenience for the user/installer. After this step, the entire assembly is lowered or partially inserted into the inner opening of the upper end of the casing until in tight sealing engagement therewith. Subsequently, the bolts are further tightened until the split plates contact with and expand the split packer into engagement with the inner surface of the end of the casing, and the outer surfaces of the drop pipe(s), power cable, vent pipe and bolts, providing a good seal.

The well seal uses a split packer which has interlocking lips and which is best comprised of rubber or synthetic rubber. The split packer which has two pipe holes has a slit about three fourths of its length. There are interlocking lips along the slit edges. The split packer is pivotable/twistable along the slit line if necessary during installation. Further, the split packer has one or a plurality of apertures through which pipes, etc., pass. The split packer is placed between two rigid plates. Also, the well seal can be used in water well systems, oil well systems, etc.

The split packer can easily be removed to work on the submerged pump, etc. The bolts holding the outer split plate and inner split plate together are partially loosened, which allows the split packer to be raised up out of the upper end of the casing. The bolts are completely loosened (but not so far as to remove them) so that the two parts of the outer split plate and the two parts of the inner split plate can be removed from around the pipe or pipes located in the casing. The interlocking lips of the flexible split packer are disconnected and the split packer opened for removal from around the pipe or pipes. The split packer can easily be reinstalled, which is one of its advantages. No sealants, adhesives, adhesive-type flexible sealants or other gaskets are necessary to effect a seal and, therefore, no possibility of chemical contamination exists.

What is claimed is:

1. A well seal for cooperating with a casing of a wall, comprising:

(a) a first split plate;

(b) a second split plate having a size and shape to allow insertion within the well casing;

(c) a split packer, which is provided with at least one tapered through hole, positioned between first split plate (a) and second split plate (b), the split packer having a size and shape approximately the same as an inner dimension of the well casing to allow insertion therein, split packer (c) having at least two sections with interlocking lips to provide an effective sanitary seal by providing a leakproof labyrinth path to avoid a straight-through leak path; and (d) clamp means for compressing split packer (c) between first split plate (a) and second split plates (b) to expand said split packer (c) into sealing engagement with an inner wall of the well casing.

2. The well seal according to claim 1 wherein the through hole is located partially through each section of split packer (c) along the interlocking lips.

3. A split packer for a well seal having a pair of clamping plates, comprising:

(i) a first section; and (ii) a second section, the first section and the second section having interlocking lips to provide an effective sanitary seal by providing a leakproof labyrinth path to avoid a straight-through leak path, the first section and the second section, when interconnected together, forming a packing unit provided with at least one tapered through hole and being of size and shape about the same as the inner dimensions of a casing of a well.

4. The split packer according to claim 3 wherein the through hole is located partially through each section along the split line.

* * * * *